US012544821B2

(12) United States Patent
Nomura et al.

(10) Patent No.: US 12,544,821 B2
(45) Date of Patent: Feb. 10, 2026

(54) DIE

(71) Applicant: NIPPON STEEL CORPORATION, Tokyo (JP)

(72) Inventors: Naruhiko Nomura, Tokyo (JP); Toshiya Suzuki, Tokyo (JP); Kenta Uenishi, Tokyo (JP); Tohru Yoshida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 148 days.

(21) Appl. No.: 17/795,492

(22) PCT Filed: Mar. 19, 2021

(86) PCT No.: PCT/JP2021/011338
§ 371 (c)(1),
(2) Date: Jul. 26, 2022

(87) PCT Pub. No.: WO2021/193417
PCT Pub. Date: Sep. 30, 2021

(65) Prior Publication Data

US 2023/0063824 A1 Mar. 2, 2023

(30) Foreign Application Priority Data

Mar. 26, 2020 (JP) ..... 2020-055210

(51) Int. Cl.
*B21D 37/16* (2006.01)
*B21D 22/02* (2006.01)

(52) U.S. Cl.
CPC ..... *B21D 37/16* (2013.01); *B21D 22/022* (2013.01)

(58) Field of Classification Search
CPC .... B21D 37/16; B21D 22/022; B21D 22/208; B21D 22/201; B21D 24/16
See application file for complete search history.

(56) References Cited

U.S. PATENT DOCUMENTS 10,576,524 B1 3/2020 Yuan et al.
2006/0138698 A1* 6/2006 Chapuis ..... B21D 22/208 264/255

(Continued)

FOREIGN PATENT DOCUMENTS

CN 105665541 A 6/2016
CN 106180392 A 12/2016

(Continued)

*Primary Examiner* — Teresa M Ekiert
(74) *Attorney, Agent, or Firm* — Birch, Stewart, Kolasch & Birch, LLP

(57) ABSTRACT

A die includes a die body and a removable shell. The die body includes a supply flow channel formed inside the die body. One end of the supply flow channel opens at the surface of the die body. The supply flow channel is to be supplied with a fluid for temperature adjustment. The removable shell is mounted removably to the surface of the die body. The removable shell includes an outer surface that constitutes at least a part of the forming surface of the die. A temperature adjustment space is provided in the surface of the die body or in the removable shell. The temperature adjustment space is in communication with the supply flow channel. The removable shell is divided into a plurality of shell pieces. The plurality of shell pieces are arranged in a direction intersecting the longitudinal direction of the die on the surface of the die body.

4 Claims, 8 Drawing Sheets

(56) References Cited

U.S. PATENT DOCUMENTS

| | | | | |
|---|---|---|---|---|
| 2013/0111965 | A1 | 5/2013 | Lee | |
| 2013/0145809 | A1 | 6/2013 | Lee | |
| 2014/0305181 | A1 | 10/2014 | Kobayashi | |
| 2015/0075246 | A1* | 3/2015 | Dorr | B21D 22/022 72/347 |
| 2016/0038989 | A1 | 2/2016 | Wu et al. | |
| 2019/0201960 | A1* | 7/2019 | Lee | B21D 37/16 |

FOREIGN PATENT DOCUMENTS

| | | | | |
|---|---|---|---|---|
| DE | 102009058657 | A1 * | 6/2011 | B21D 37/16 |
| DE | 10 2010 011 087 | A1 | 9/2011 | |
| DE | 10 2018 212 122 | A1 | 1/2020 | |
| EP | 0 361 390 | A2 | 4/1990 | |
| JP | 2006-198666 | A | 8/2006 | |
| JP | 2013-99774 | A | 5/2013 | |
| JP | 2013-119119 | A | 6/2013 | |
| JP | 2014-205164 | A | 10/2014 | |
| JP | 2017-80759 | A | 5/2017 | |
| JP | 2018-83223 | A | 5/2018 | |
| KR | 10-1309165 | B1 | 9/2013 | |
| KR | 10-1581940 | B1 | 12/2015 | |
| KR | 10-2018-0115836 | A | 10/2018 | |

* cited by examiner

DIE

TECHNICAL FIELD

The present disclosure relates to a die, more specifically, a die used for hot pressing.

BACKGROUND ART

As a method for forming a high-strength part such as automobile body parts, hot pressing has been known. In the hot pressing, a heated blank is pressed with dies attached to the press machine, and the blank is cooled and quenched in the dies.

Patent Literature 1 discloses a press tooling for hot pressing. This press tooling is constituted of a punch that is a lower die and a die set that is an upper die. In the punch and the die set, a plurality of cooling water pipes that penetrate them in the longitudinal direction are provided. Moreover, in the punch and the die set, a plurality of refrigerant flow channels that penetrate them in the longitudinal direction are provided. To each of the refrigerant flow channels, a plurality of communication paths, which open at the forming surface of the punch or the die set, are connected.

When press working is performed by the press tooling of Patent Literature 1, first, water as the refrigerant is made to flow in each cooling water pipe to cool the punch and the die set to a predetermined temperature. Next, a heated blank is placed between the punch and the die set, and the die set is lowered to deform the blank. When the die set reaches the bottom dead center, introduction of refrigerant into each refrigerant flow channel is started. The refrigerant introduced into the refrigerant flow channel is ejected from the forming surface through a communication path. According to Patent Literature 1, the blank is cooled by direct contact with the cooled die set and punch, and by the refrigerant ejected from the forming surface.

Patent Literatures 2 to 4 also disclose a die for hot pressing. The die of Patent Literature 2 includes an outer shape block having a forming surface, and an insert block to be inserted into the outer shape block. The insert block has a plurality of grooves for flowing the refrigerant, in its outer surface. Each groove is formed in the outer surface of the insert block such that it crosses substantially the entire insert block in a lateral direction (width direction).

The die of Patent Literature 3 includes a lower die, and an upper die formed of a material different from that of the lower die. The upper die is placed on the lower die and has a plurality of grooves for flowing refrigerant, on its underside. These grooves are formed on the underside of the upper die so as to traverse substantially the entire upper die in the lateral direction (width direction).

The die of Patent Literature 4 includes a first split body having a forming surface, and a second split body to be combined with the first split body. The first split body has a groove that opens on the second split body side. In the die of Patent Literature 4, a flow channel for circulating refrigerant is formed of a portion surrounded by the groove of the first split body, and the second split body.

CITATION LIST

Patent Literature

Patent Literature 1: Japanese Patent Application Publication No. 2014-205164

Patent Literature 2: Japanese Patent Application Publication No. 2013-99774

Patent Literature 3: Japanese Patent Application Publication No. 2013-119119

Patent Literature 4: Japanese Patent Application Publication No. 2018-83223

SUMMARY OF INVENTION

Technical Problem

For example, a plurality of cooling water pipes are provided in each die of Patent Literature 1 to cool the press tooling itself. Since especially the forming surface of the die becomes high temperature during hot pressing, such cooling water pipes are usually disposed near the forming surface of the press tooling. However, in this case, since a large number of spaces are produced in the vicinity of the forming surface, the load bearing capacity of the forming surface becomes insufficient. In other words, the strength of the die decreases.

An object of the present disclosure is to provide a die that is able to adjust the temperature of the forming surface, as well as to ensure strength.

Solution to Problem

A die according to the present disclosure includes a forming surface. The die includes a die body and a removable shell. The die body includes a supply flow channel. The supply flow channel is formed inside the die body. One end of the supply flow channel opens at the surface of the die body. The supply flow channel is to be supplied with a fluid for temperature adjustment. The removable shell is mounted removably to the surface of the die body. The removable shell includes an outer surface that constitutes at least a part of the forming surface of the die. A temperature adjustment space is provided in the surface of the die body or in the removable shell. The temperature adjustment space is in communication with the supply flow channel. The removable shell is divided into a plurality of shell pieces. The plurality of shell pieces are arranged in a direction intersecting the longitudinal direction of the die on the surface of the die body.

Advantageous Effects of Invention

According to the present disclosure, it is possible to adjust the temperature of the forming surface of the die, as well as to ensure the strength of the die.

DESCRIPTION OF EMBODIMENTS

Figure 1:
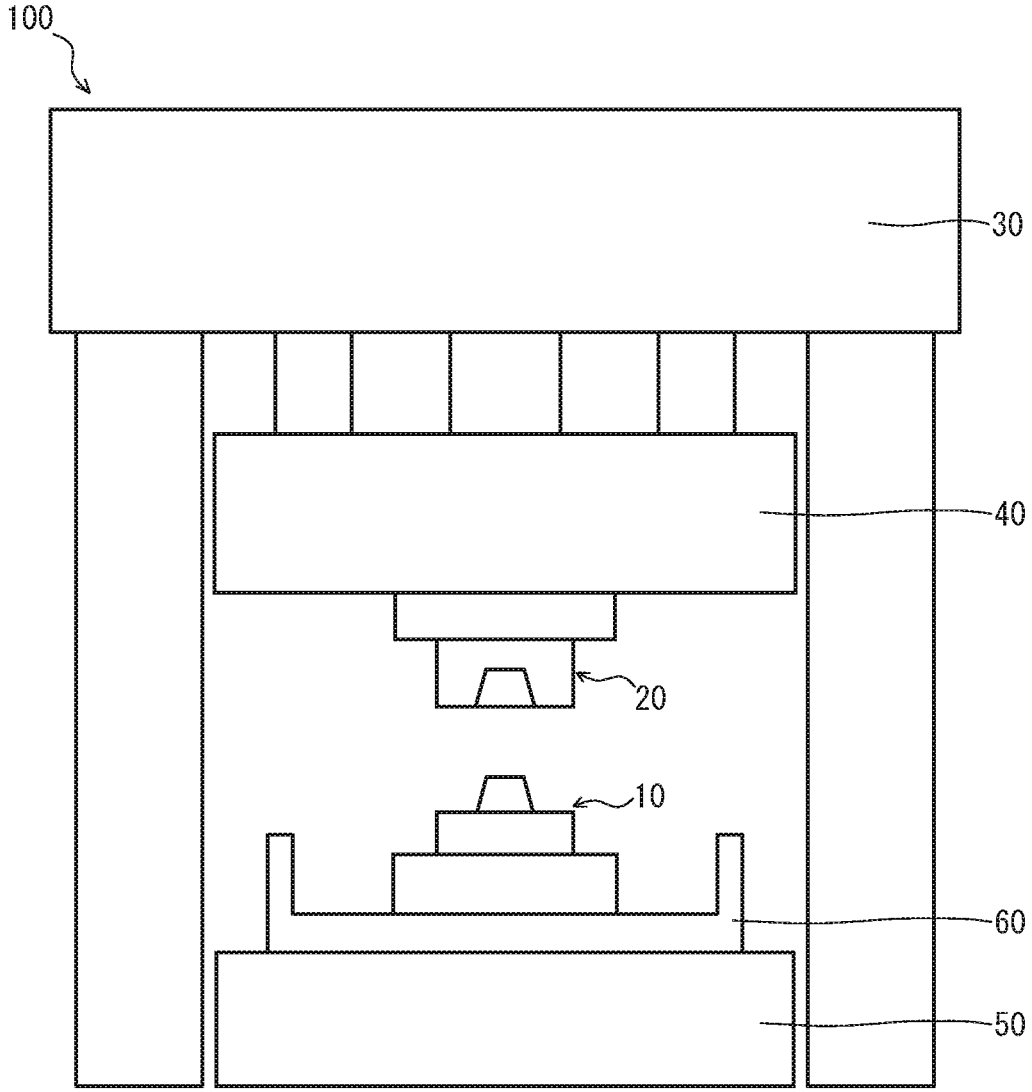
FIG. 1 is a schematic diagram showing a press machine.

The die according to an embodiment includes a forming surface. The die includes a die body and a removable shell. The die body includes a supply flow channel. The supply flow channel is formed inside the die body. One end of the supply flow channel opens at the surface of the die body. The supply flow channel is to be supplied with a fluid for temperature adjustment. The removable shell is mounted removably to the surface of the die body. The removable shell includes an outer surface that constitutes at least a part of the forming surface of the die. A temperature adjustment space is provided in the surface of the die body or in the removable shell. The temperature adjustment space is in communication with the supply flow channel. The removable shell is divided into a plurality of shell pieces. The plurality of shell pieces are arranged in a direction intersecting the longitudinal direction of the die on the surface of the die body (first configuration).

In the die according to the first configuration, the temperature of the forming surface is adjusted by a fluid for temperature adjustment which has flown into the temperature adjustment space from the supply flow channel. In other words, the temperature of the forming surface of the die is directly adjusted by the fluid in the temperature adjustment space. This temperature adjustment space is located in a distributed manner in the surface of the die body, or in the removable shell that can be mounted to or removed from the surface of the die body. Therefore, the working load during press working is distributed over the contact surface between the die body and the removable shell. Therefore, it is possible to adjust the temperature of the forming surface as well as to secure the strength of the die.

On the forming surface of the die, the degree of wear varies depending on the region. For example, among the forming surfaces of the die, the portion that rubs with the blank wears faster than the portion where the blank is simply sandwiched. According to the first configuration, the removable shell mounted removably to the die body is divided into a plurality of shell pieces. Therefore, the removable shell can be partially replaced. For example, among the plurality of shell pieces included in the removable shell, the forming surface can be partially repaired by replacing the worn shell piece. Therefore, it is not necessary to repair the entire die or prepare a new die, and thus repair of the die can be easily performed.

The removable shell may further include a through hole. One end of the through hole opens into the temperature adjustment space. Further, the other end of the through hole opens at the outer surface of the removable shell (second configuration).

According to the second configuration, the fluid flowing into the temperature adjustment space can be ejected from the outer surface of the removable shell. Therefore, the fluid for temperature adjustment can be supplied to the formed article on the die.

In general, since the material strength of a die body is high, it is not easy to form a through hole in a die for ejecting the fluid for temperature adjustment from the forming surface. In particular, the diameter required for the through hole for ejection is small from the viewpoint of improving the flow velocity. In order to form such a through hole in the die, complex path processing is required to gradually reduce the hole diameter from the supply flow channel of the fluid for temperature adjustment in order to avoid increase of pressure loss. In addition, since the length of the through hole tends to be large, it is not practical to accurately form a large number of through holes in the die in terms of the difficulty in processing, as well as in terms of cost. For example, conventionally, when a small diameter through hole is required, work such as first forming a large diameter through hole in the die, and disposing a screw or the like having a small diameter through hole in the large diameter through hole is performed. In contrast to this, according to the second configuration, a through hole for ejecting the fluid for temperature adjustment from the forming surface may be formed in the removable shell. The removable shell constitutes a near surface portion of the die, and has a small thickness. Thus, a through hole of the desired diameter can be easily formed.

The temperature adjustment space is preferably formed by a groove provided in the inner surface of the removable shell. The inner surface of the removable shell is the surface of the die body side (third configuration).

When the temperature adjustment space is constituted by the groove in the inner surface of the removable shell, the thickness of the removable shell can be reduced compared with, for example, a case where the removable shell is formed into a hollow box shape. Moreover, since a portion other than the groove of the inner surface of the removable shell is supported by the surface of the die body, and the supported area of the removable shell increases, deformation of the removable shell can be suppressed.

Hereinafter, embodiments of the present disclosure will be described while referring to the drawings. The same or equivalent configuration is designated by the same reference symbol in each figure, and the same description will not be repeated.

First Embodiment

[Configuration of Press Machine]

FIG. 1 is a schematic diagram showing a press machine 100. The press machine 100 is provided with dies 10 and 20. FIG. 1 shows the press machine 100 viewed from the front. In the present embodiment, the direction perpendicular to the paper surface of FIG. 1 is a depth direction of the press machine 100.

The press machine 100 includes a main body frame 30, a slide 40, a bolster 50, and a base plate 60.

The slide 40 is mounted to the main body frame 30. The slide 40 moves up and down with respect to the main body frame 30 by operation of a hydraulic cylinder, a flywheel, or the like housed in the main body frame 30. The slide 40 holds the die 20.

The bolster 50 is disposed below the slide 40. The base plate 60 is fixed onto the bolster 50. The base plate 60 has a concave shape. The die 10 is mounted to the base plate 60. The base plate 60 adjusts the position of the die 10 in the vertical direction. The die 10 faces the die 20.

The dies 10 and 20 extend in the depth direction of the press machine 100. Hereinafter, with respect to the dies 10 and 20, the depth direction of the press machine 100 is referred to as the longitudinal direction, and a direction perpendicular to the longitudinal direction and the vertical direction is referred to as a lateral direction.

Figure 2:
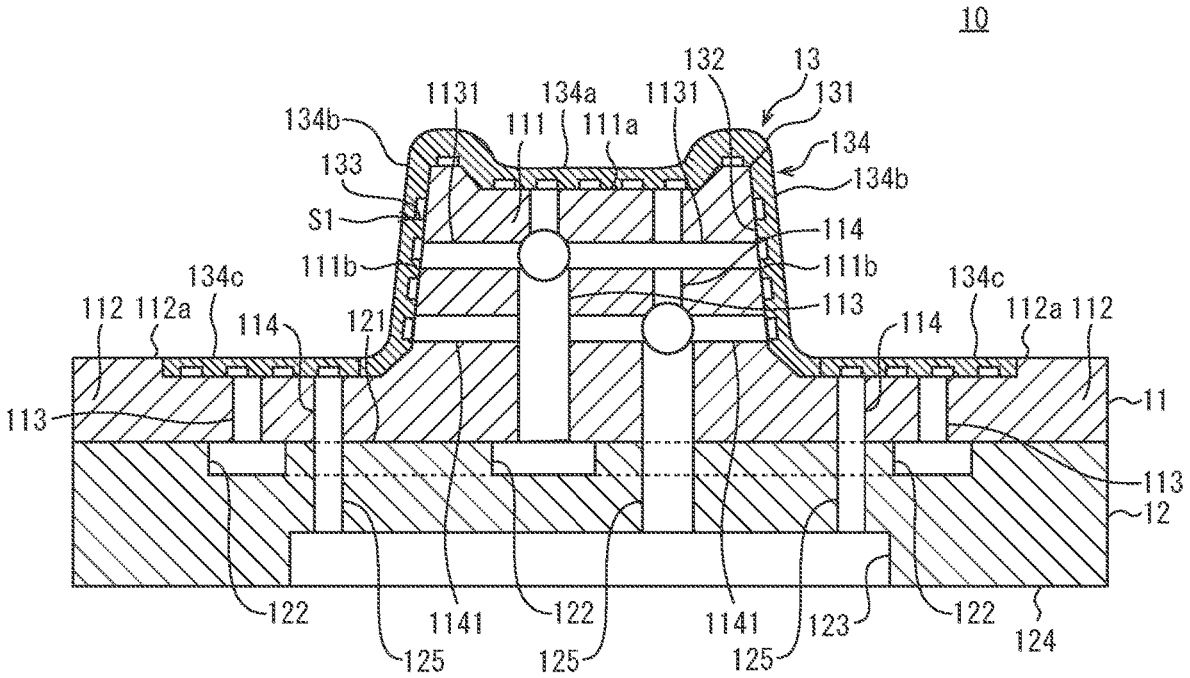
FIG. 2 is a cross-sectional view of the die (lower die) according to the first embodiment.

FIG. 2 is a cross-sectional view showing the outline configuration of the die 10. A cross section is a section perpendicular to the longitudinal direction. As shown in FIG. 2, the die 10 includes a die body 11, a die base 12, and a removable shell 13.

In the present embodiment, the die body 11 has a schematic hat shape viewed from the longitudinal direction. In other words, the die body 11 includes a punch part 111 and flange parts 112.

The punch part 111 is disposed at the middle in the lateral direction of the die body 11. The punch part 111 includes a top surface 111*a* and side surfaces 111*b*. The side surfaces 111*b* are located on both sides of the top surface 111*a*. Each of the side surfaces 111*b* is inclined with respect to the vertical direction outward in the lateral direction as they are closer to the bottom from the top surface 111*a*. Each flange part 112 protrudes outward in the lateral direction from the punch part 111. The upper surface 112*a* of the flange part 112 is connected to the lower end of the side surface 111*b* of the punch part 111.

The die body 11 includes a plurality of supply flow channels 113 and a plurality of discharge flow channels 114. Each of the supply flow channels 113 and the discharge flow channels 114 penetrates the die body 11 in the vertical direction. The upper ends of the supply flow channel 113 and the discharge flow channel 114 open at the surface of the die body 11. More specifically, the upper ends of the supply flow channel 113 and the discharge flow channel 114 open at the top surface 111*a* of the punch part 111 or the upper surface 112*a* of the flange part 112. The lower ends of the supply flow channel 113 and the discharge flow channel 114 open at the lower surface of the die body 11.

Of the plurality of supply flow channels 113, two branch supply paths 1131 are provided on the supply flow channel 113 that opens at the top surface 111*a* of the punch part 111. Each of the branch supply paths 1131 extends from the supply flow channel 113 in the lateral direction of the die 10. Each branch supply path 1131 may be inclined or bent with respect to the lateral direction of the die 10. One of the two branch supply paths 1131 opens at one side surface 111*b* of the punch part 111. The other branch supply path 1131 opens at the other side surface 111*b* of the punch part 111.

In the discharge flow channel 114 that opens at the top surface 111*a* of the punch part 111 among the plurality of discharge flow channels 114, two branch discharge paths 1141 are provided. Each of the branch discharge paths 1141 extends from the discharge flow channel 114 in the lateral direction of the die 10. Each branch discharge path 1141 may be inclined or bent with respect to the lateral direction of the die 10. One of the two branch discharge paths 1141 opens at one side surface 111*b* of the punch part 111. The other branch discharge path 1141 opens at the other side surface 111*b* of the punch part 111.

The sectional shapes of the supply flow channel 113, the branch supply path 1131, the discharge flow channel 114, and the branch discharge path 1141 are, for example, circular. However, the sectional shapes of the supply flow channel 113, the branch supply path 1131, the discharge flow channel 114, and the branch discharge path 1141 may be other shapes.

The cross-sectional areas of the supply flow channel 113, the branch supply path 1131, the discharge flow channel 114, and the branch discharge path 1141 may be different from each other or may be the same. Each of the supply flow channel 113, the branch supply path 1131, the discharge flow channel 114, and the branch discharge path 1141 may be configured such that the cross-sectional area is constant throughout, or such that the cross-sectional area varies on the way.

The die body 11 is placed on the die base 12. The die body 11 is mounted to the die base 12. The die base 12 has, for example, a substantially cuboid outer shape.

A concave conduit 122 is formed in the upper surface 121 of the die base 12. The conduit 122 is, for example, a plurality of grooves provided in the upper surface 121 corresponding to the supply flow channels 113 of the die body 11. However, the configuration of the conduit 122 is not limited thereto. The conduit 122 is supplied with a fluid for temperature adjustment. In the present embodiment, the fluid for temperature adjustment is refrigerant for cooling the die 10. The refrigerant is typically water. The lower ends of the supply flow channels 113 are connected to the conduit 122.

A conduit 123 which is different from the conduit 122 is also formed in the die base 12. The conduit 123 is, for example, a space provided on the lower surface 124 side of the die base 12. The conduit 123 is connected to the discharge flow channels 114 of the die body 11 by a plurality of connection paths 125. The connection paths 125 are provided corresponding to the discharge flow channels 114, in the die base 12.

The removable shell 13 is a member which is separate from the die body 11. The removable shell 13 is formed of, for example, a metal. The material of the removable shell 13 may be the same as or different from the material of the die body 11. The removable shell 13 is mounted removably to the surface of the die body 11. Although not particularly limited, the removable shell 13 is fixed to the surface of the die body 11 with bolts after it is positioned with a knock pin, for example. The outer surface 131 of the removable shell 13 constitutes at least a part of the forming surface of the die 10. The inner surface 132 of the removable shell 13 is located on the die body 11 side. The inner surface 132 is provided with a groove 133. The groove 133 forms a temperature adjustment space S1 for adjusting the temperature of the forming surface of the die 10.

The thickness of the removable shell 13 is preferably 5 mm to 10 mm. The thickness of the removable shell 13 refers to the length from the contact surface between the removable shell 13 and the die body 11 to the outer surface 131 of the removable shell 13. In the example of the present embodiment, the removable shell 13 is divided into a plurality of shell pieces 134. In other words, the removable shell 13 is constituted of the plurality of shell pieces 134. In the die 10 according to the present embodiment, the plurality of shell pieces 134 are provided for one die body 11.

The plurality of shell pieces 134 are arranged in a direction intersecting the longitudinal direction of the die 10 on the surface of the die body 11. Therefore, when viewed in a cross section of the die 10, an end face (split line of the removable shell 13) of each shell piece 134 stands up from the surface of the die body 11 toward the outer surface 131 of the removable shell 13. In the cross-sectional view of the die 10, the length of each shell piece 134 in the direction along the forming surface of the die 10 is, of course, smaller than the entire length of the forming surface in the aforementioned direction. The shell pieces 134 are removable with respect to the die body 11, respectively. In other words, each shell piece 134 can be mounted to the die body 11 as well as can be removed from the die body 11.

In the present embodiment, the removable shell 13 includes shell pieces 134*a* to 134*c*. The shell pieces 134*a* to 134*c* are mounted to any of the surfaces 111*a*, 111*b*, and

112*a* being a plurality of surfaces constituting the surface of the die body 11 and having different orientations from each other. In the example of FIG. 2, the shell piece 134*a* is mounted to the top surface 111*a* of the punch part 111. The shell piece 134*a* is removable substantially in the normal direction with respect to the top surface 111*a* of the punch part 111. The shell piece 134*b* is mounted to each side surface 111*b* of the punch part 111. The shell piece 134*b* is removable substantially in the normal direction with respect to each side surface 111*b* of the punch part 111. The shell piece 134*c* is mounted to the upper surface 112*a* of the flange part 112. The shell piece 134*c* is removable substantially in the normal direction with respect to the upper surface 112*a* of the flange part 112. Of the upper surface 112*a* of the flange part 112, the portion to which the shell piece 134*c* is mounted has a concave shape compared to other portions.

Figure 3:
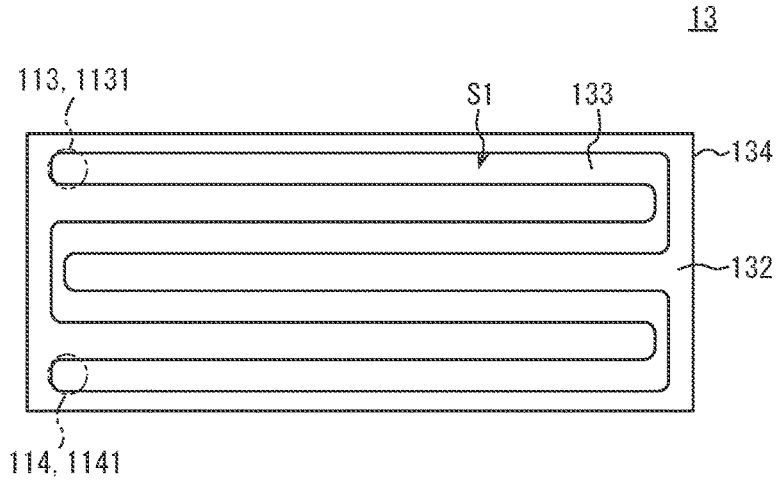
FIG. 3 shows a removable shell, which is included in the die shown in FIG. 2, viewed from the inner surface side.

FIG. 3 shows the removable shell 13 viewed from the inner surface 132 side. In FIG. 3, one of the plurality of shell pieces 134 included in the removable shell 13 is exemplified.

As shown in FIG. 3, a groove 133 is formed in the inner surface 132 of the removable shell 13. The groove 133 is formed for each shell piece 134. The depth of the groove 133 and the distance from the outer surface 131 to the groove 133 in each shell piece 134 are preferably equal to the depth of the groove 133 and the distance from the outer surface 131 to the groove 133 in another shell piece 134. Although not particularly limited, the groove 133 is formed in each shell piece 134, for example, so as to reciprocate between the opposite side edges. The groove 133 is in communication with the supply flow channel 113 and the discharge flow channel 114. For example, a supply flow channel 113 or a branch supply path 1131 is connected at one end of the groove 133, and a discharge flow channel 114 or a branch discharge path 1141 is connected to the other end of the groove 133.

Figure 4:
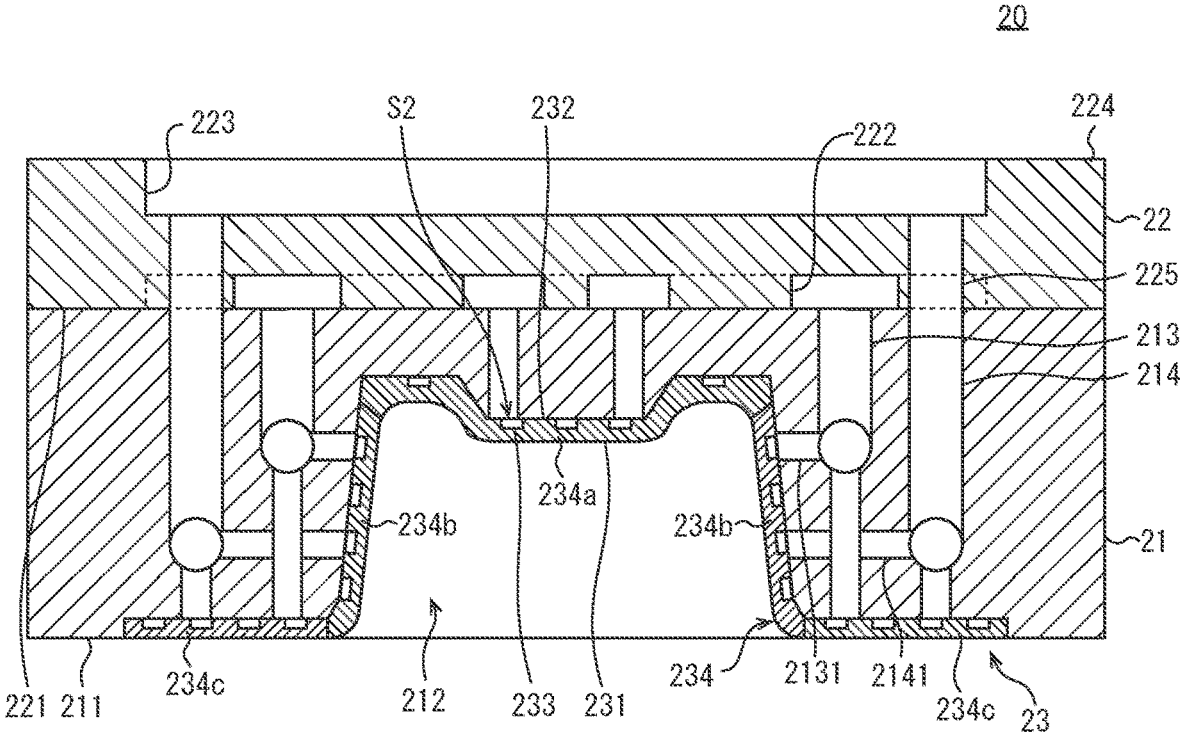
FIG. 4 is a cross-sectional view of the die (upper die) according to the first embodiment.

FIG. 4 is a cross sectional view showing the schematic configuration of the die 20. As shown in FIG. 4, the die 20 includes a forming surface having an upwardly concave shaped corresponding to the die 10 including a forming surface having an upwardly convex shape. The die 20 includes a die body 21, a die base 22, and a removable shell 23.

The die body 21 has a concave portion 212 in its lower surface 211. The die body 21 includes a plurality of supply flow channels 213 and a plurality of discharge flow channels 214. Some supply flow channels 213 are provided with a branch supply path 2131. A branch discharge path 2141 is provided in some discharge flow channels 214. Since the configuration of the supply flow channel 213, the branch supply path 2131, the discharge flow channel 214, and the branch discharge path 2141 is the same as the configuration of the supply flow channel 113, the branch supply path 1131, the discharge flow channel 114, and the branch discharge path 1141 (FIG. 2) in the die body 11 of the die 10, detailed description thereof will be omitted.

The die base 22 has, for example, a substantially cuboid outer shape. The die base 22 is disposed above the die body 21. The die body 21 is mounted to the lower surface 221 of the die base 22. In the lower surface 221 of the die base 22, a conduit 222 similar to the conduit 122 (FIG. 2) in the die base 12 of the die 10 is formed. The conduit 222 is supplied with a fluid for temperature adjustment. In the present embodiment, the fluid for temperature adjustment is refrigerant for cooling the die 20, and is typically water. On the upper surface 224 side of the die base 22, a conduit 223 and connection paths 225 similar to the conduit 123 and the connection paths 125 (FIG. 2) in the die base 12 of the die 10 are formed.

The removable shell 23 is configured in the same way as the removable shell 13 (FIG. 2) of the die 10. The removable shell 23 is a member separate from the die body 21. The removable shell 23 is formed of, for example, a metal. The material of the removable shell 23 may be the same as or different from the material of the die body 21. The removable shell 23 is mounted removably to the surface of the die body 21. Although not particularly limited, the removable shell 23 is fixed to the surface of the die body 21 by bolts after being positioned with a knock pin, for example. The outer surface 231 of the removable shell 23 constitutes at least a part of the forming surface of the die 20. The inner surface 232 of the removable shell 23 is located on the die body 21 side. The inner surface 232 is provided with a groove 233. The groove 233 forms a temperature adjustment space S2 for adjusting the temperature of the forming surface of the die 20.

The thickness of the removable shell 23 is preferably 5 mm to 10 mm. The thickness of the removable shell 23 refers to the length from the contact surface between the removable shell 23 and the die body 21 to the outer surface 231 of the removable shell 23. The removable shell 23 is divided into a plurality of shell pieces 234. In other words, the removable shell 23 is constituted of the plurality of shell pieces 234. In the die 20 according to the present embodiment, the plurality of shell pieces 234 are provided for one die body 21.

The plurality of shell pieces 234 are arranged in a direction intersecting the longitudinal direction of the die 20, on the surface of the die body 21. Therefore, when viewed in a cross section of the die 20, the end face of each shell piece 234 (division line of the removable shell 23) stands up from the surface of the die body 21 toward the outer surface 231 of the removable shell 23. In the cross-sectional view of the die 20, the length of each of the shell pieces 234 in the direction along the forming surface of the die 20 is, of course, smaller than the entire length of the forming surface in the aforementioned direction. The shell pieces 234 are removable with respect to the die body 21, respectively. In other words, for each shell piece 234, it can be mounted to the die body 21 and can be removed from the die body 21. Each of the shell pieces 234 is formed with a groove 233 similar to that of the shell piece 134 (FIG. 3) of the removable shell 13 in the die 10. The depth of the groove 233 and the distance from the outer surface 231 to the groove 233 in each shell piece 234 are preferably equal to the depth of the groove 233 and the distance from the outer surface 231 to the groove 233 in another shell piece 234.

In the present embodiment, the removable shell 23 includes shell pieces 234*a* to 234*c*. The shell pieces 234*a* to 234*c* are mounted to any of the surfaces constituting the surface of the die body 21 and having different orientations from each other. In the example of FIG. 4, the shell piece 234*a* is mounted to the bottom surface of the concave portion 212 of the die body 21. The shell piece 234*a* is removable substantially in the normal direction with respect to the bottom surface of the concave portion 212. The shell piece 234*b* is mounted to each side surface of the concave portion 212. The shell piece 234*b* is substantially removable with respect to each side surface of the concave portion 212. The shell pieces 234*c* are disposed on both outsides of the concave portion 212 in the lateral direction of the die 20 and are mounted to the lower surface 211 of the die body 21.

Each shell piece 234*c* is removable substantially in the normal direction with respect to the lower surface 211 of the die body 21.

[Operation of Press Machine]

Next, the operation of the press machine 100 when producing a formed article will be described. Referring to FIG. 1, first, a heated blank (not illustrated) is placed on the die 10. Next, by lowering the slide 40, the die 20 is made to reach a bottom dead center. Thereby, the blank is pressed by the die 20 and the die 10, and the formed article is produced.

When blanks are pressed repeatedly, the temperature of the forming surfaces of the dies 10, 20 rise due to the heat of the heated blanks. Therefore, the dies 10, 20 are cooled. Typically, the dies 10, 20 are continuously cooled while the formed articles are produced. However, the dies 10, 20 can also be temporarily cooled.

Referring to FIG. 2 again, when cooling the die 10, the refrigerant is continuously introduced to the conduit 122 of the die base 12, for example, by fluid pressure feeding means (not illustrated) provided outside the die 10. Examples of the fluid pressure feeding means include pumps and cylinders disposed between the conduit 122 and a refrigerant tank. The conduit 122 may be directly connected to the water supply. The refrigerant introduced into the conduit 122 is supplied to each supply flow channel 113 of the die body 11. The refrigerant flows into the removable shell 13 through the supply flow channel 113. More specifically, the refrigerant flows into the groove 133 of each shell piece 134*a* to 134*c* from the supply flow channel 113 or the branch supply path 1131.

As a result of the refrigerant flowing through the groove 133 of each shell piece 134*a* to 134*c*, the heat of the removable shell 13 is dissipated. Since the removable shell 13 is thin, the outer surface 131, that is, the forming surface of the die 10 is also sufficiently cooled. The refrigerant which has flown through the groove 133 is discharged from the removable shell 13 through the discharge flow channel 114 or the branch discharge path 1141 of the die body 11. The refrigerant is collected in the conduit 123 of the die base 12 through the discharge flow channels 114 of the die body 11 and the connection paths 125 of the die base 12 and discharged from the conduit 123. The refrigerant discharged from the conduit 123 may be either discarded or circulated for use.

Referring to FIG. 4, when cooling the die 20, the refrigerant is continuously introduced into the conduit 222 of the die base 22, for example, by the above-described fluid pressure feeding means (not illustrated). The refrigerant introduced into the conduit 222 is supplied to each supply flow channel 213 of the die body 21. The refrigerant flows into the removable shell 23 through the supply flow channel 213. More specifically, the refrigerant flows into the groove 233 of each shell piece 234*a* to 234*c* from the supply flow channel 213 or the branch supply path 2131.

As a result of refrigerant flowing through the groove 233 of each shell piece 234*a* to 234*c*, heat of the removable shell 23 is dissipated. Since the removable shell 23 is thin, the outer surface 231, that is, the forming surface of the die 20 is also sufficiently cooled. The refrigerant which has flown through the groove 233 is discharged from the removable shell 23 through the discharge flow channel 214 or the branch discharge path 2141 of the die body 21. The refrigerant is collected in the conduit 223 of the die base 22 through the discharge flow channels 214 of the die body 21 and the connection paths 225 of the die base 22 and discharged from the conduit 223. The refrigerant discharged from the conduit 223 may be either discarded or circulated for use.

[Advantageous Effects of the First Embodiment]

In the dies 10 and 20 according to the present embodiment, the forming surfaces are cooled by the refrigerant which has flown into each groove 133 of the removable shell 13 and each groove 233 of the removable shell 23. In other words, the groove 133 of the removable shell 13 and the groove 233 of the removable shell 23 function as the temperature adjustment spaces S1, S2, respectively, for cooling the forming surfaces of the dies 10, 20. Thus, by providing the temperature adjustment spaces S1, S2 in a distributed manner in the removable shells 13, 23 constituting the forming surfaces of the dies 10, 20, the working load during press working can be distributed over the contact surfaces between the die bodies 11, 21 and the removable shells 13, 23. Therefore, according to the dies 10 and 20 of the present embodiment, it is possible to cool the forming surfaces of the dies 10, 20, as well as to secure the strength of the dies 10, 20.

In the dies 10 and 20 according to the present embodiment, the thicknesses of the removable shells 13, 23 mounted removably to the die bodies 11, 21 are small. The thicknesses of the removable shells 13, 23 are, for example, 5 mm to 10 mm. Therefore, it is possible to reduce the amount of deformation of the removable shells 13, 23 due to the working load during press working. Further, the small thicknesses of the removable shells 13, 23 suppress decrease in sectional rigidity of the die bodies 11, 21. Therefore, it is possible to secure the rigidity and the load bearing capacity of the dies 10 and 20.

Reducing the thicknesses of the removable shells 13, 23 allow to reduce the heat capacity of the removable shells 13, 23. Therefore, the removable shells 13, 23, which constitute the forming surfaces of the dies 10, 20, become easier to be cooled.

In the present embodiment, in particular, grooves 133, 233 are formed in the inner surfaces 132, 232 of the removable shells 13, 23, and the temperature adjustment spaces S1, S2 are constituted of the grooves 133, 233. Therefore, the thicknesses of the removable shells 13, 23 can be further reduced, and the displacement in the thickness direction of the removable shells 13, 23 can be reduced. Further, in the inner surfaces 132, 232 of the removable shells 13, 23, not only a peripheral edge portion but also a portion between grooves 133 or between grooves 233 is supported by the die body 11 or 21, thus increasing the supported area of the removable shells 13, 23 and suppressing the deformation of the removable shells 13, 23. Therefore, it is possible to further increase the strength of the dies 10, 20.

When the grooves 133, 233 as the temperature adjustment spaces S1, S2 are formed in the inner surfaces 132, 232 of the removable shells 13, 23 instead of in the surfaces of the die bodies 11, 21 as in the present embodiment, reparability of the dies 10, 20 is improved. In other words, even if deformation such as wear and dents of the forming surface occurs in the dies 10, 20, damage by such deformation is unlikely to extend to the die bodies 11, 21 having no groove. Therefore, the dies 10, 20 can be repaired only by replacing the removable shells 13, 23. Even if damage by such deformation extends to the die bodies 11, 21, the die bodies 11, 21 only have flow channels 113, 114, 213, 214 inside thereof, and have no groove in their surfaces, so that the die bodies 11, 21 can be easily repaired compared to when there is a groove in the surfaces of the die bodies 11, 21. Further, it is easier to provide the grooves 133, 233 in the removable shells 13, 23 than to provide a groove in the die bodies 11, 21.

In the dies 10 and 20 according to the present embodiment, the groove 133 as the temperature adjustment space S1 is in communication with a supply flow channel 113 and a discharge flow channel 114 of the die body 11, and the groove 233 as the temperature adjustment space S2 is in communication with a supply flow channel 213 and a discharge flow channel 214 of the die body 21. When cooling the forming surfaces of the dies 10, 20, fresh refrigerant is supplied from the supply flow channels 113, 213 to the temperature adjustment spaces S1, S2, and the refrigerant whose temperature has risen due to heat exchange with the forming surfaces is discharged from the discharge flow channels 114, 214. In other words, since the refrigerant in the temperature adjustment spaces S1, S2 is constantly replaced, the forming surfaces of the dies 10, 20 can be appropriately cooled.

In the dies 10 and 20 according to the present embodiment, the removable shell 13 is divided into the plurality of shell pieces 134 and the removable shell 23 is divided into the plurality of shell pieces 234. The shell pieces 134, 234 are removable for the die bodies 11, 21, respectively. Therefore, for example, if some of the plurality of shell pieces 134, 234 are worn, only the worn shell pieces 134, 234 can be replaced. In other words, partial repair of the dies 10, 20 can be performed. Therefore, when the forming surfaces of the dies 10, 20 are partially worn, it is not necessary to repair the entire dies 10, 20 or prepare a new die, and thereby the reparability of the dies 10, 20 can be improved.

In the present embodiment, the temperature adjustment spaces S1, S2 are used to cool the dies 10, 20, but the temperature adjustment spaces S1, S2 can also be used to keep the temperature of the dies 10, 20. When keeping the temperature of the dies 10, 20, for example, high-temperature oil or the like may be selected as the fluid for temperature adjustment.

Second Embodiment

Figure 5:
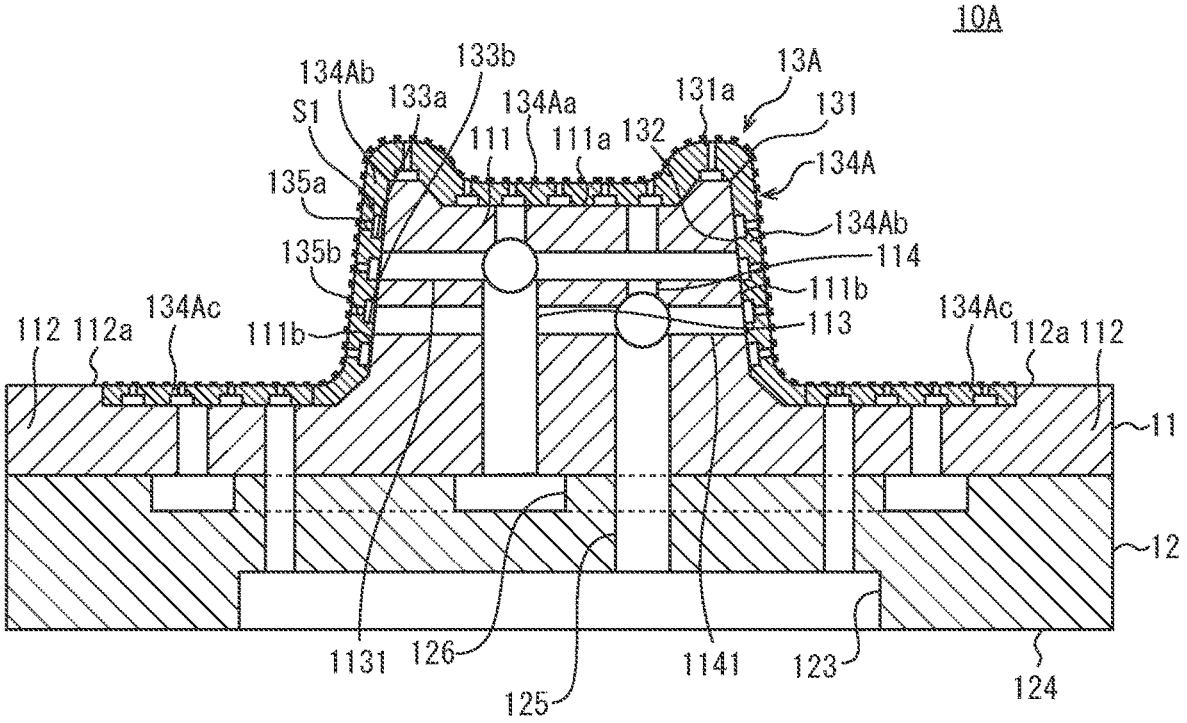
FIG. 5 is a cross-sectional view of the die (lower die) according to the second embodiment.
Figure 6:
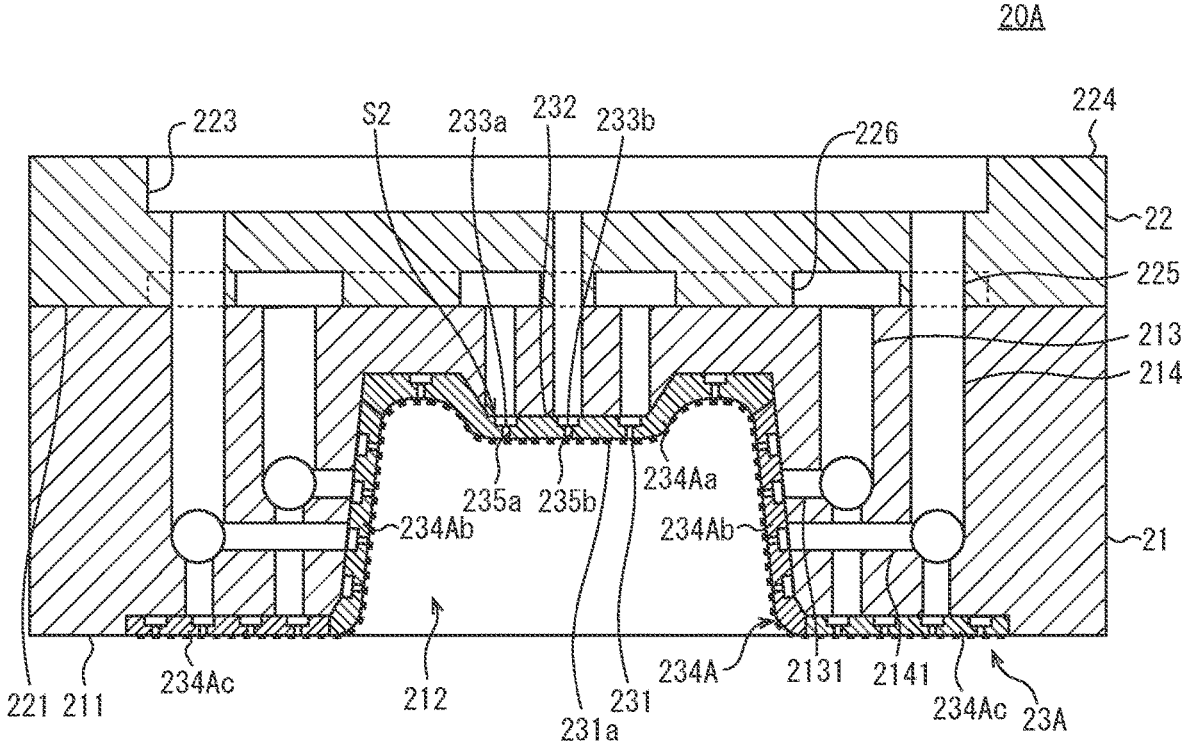
FIG. 6 is a cross-sectional view of the die (upper die) according to the second embodiment.

FIGS. 5 and 6 are cross-sectional views of dies 10A and 20A according to the second embodiment. The die 10A differs from the die 10 (FIG. 2) according to the first embodiment in the configuration of the removable shell 13A. The die 20A differs from the die 20 (FIG. 4) according to the first embodiment in the configuration of the removable shell 23A.

Referring to FIG. 5, the removable shell 13A of the die 10A has grooves 133*a*, 133*b* in the inner surface 132. The groove 133*a* functions as a temperature adjustment space S1. The removable shell 13A further includes a plurality of through holes 135*a*, 135*b*.

One end of each through hole 135*a* opens in the groove 133*a* as the temperature adjustment space S1. The other end of each through hole 135*a* opens at the outer surface 131 of the removable shell 13A. One end of each through hole 135*b* opens in the groove 133*b* different from the groove 133*a* as the temperature adjustment space S1. The other end of each through hole 135*b* opens at the outer surface 131 of the removable shell 13A as in the same manner as the through hole 135*a*.

The removable shell 13A is divided into a plurality of shell pieces 134A. The removable shell 13A is constituted of the plurality of shell pieces 134A. The removable shell 13A includes shell pieces 134Aa to 134Ac corresponding to the top surface 111*a* and both side surfaces 111*b* of the punch part 111, and the upper surface 112*a* of each flange part 112, respectively. The shell pieces 134Aa to 134Ac are arranged in the direction intersecting the longitudinal direction of the die 10A on the surface of the die body 11 in the same manner as the shell pieces 134*a* to 134*c* (FIG. 2) in the first embodiment.

A plurality of convex portions 131*a* are provided on the outer surface 131 of the removable shell 13A. The convex portions 131*a* are provided at a substantially equal density on the outer surface 131. These convex portions 131*a* can be formed, for example, by etching the outer surface 131. In the present embodiment, the convex portions 131*a* are provided over the entire area of the outer surface 131. In other words, the plurality of convex portions 131*a* are formed in each of the plurality of shell pieces 134A. However, these convex portions 131*a* may be formed only in some shell pieces 134A. The convex portion 131*a* is preferably provided so as not to interfere with the through holes 135*a*, 135*b*.

Referring to FIG. 6, the removable shell 23A of the die 20A has grooves 233*a*, 233*b* in the inner surface 232 thereof. The groove 233*a* functions as a temperature adjustment space S2. The removable shell 23A further includes a plurality of through holes 235*a*, 235*b*.

One end of each through hole 235*a* opens in the groove 233*a* as the temperature adjustment space S2. The other end of each through hole 235*a* opens at the outer surface 231 of the removable shell 23A. One end of each through hole 235*b* opens in the groove 233*b* different from the groove 233*a* as the temperature adjustment space S2. The other end of each through hole 235*b* opens at the outer surface 231 of the removable shell 23A in the same manner as the through hole 235*a*.

The removable shell 23A is divided into a plurality of shell pieces 234A. The removable shell 23A is constituted of the plurality of shell pieces 234A. The removable shell 23A includes the shell pieces 234Aa to 234Ac corresponding to the bottom surface and both side surfaces of the concave portion 212, as well as the lower surface 211 of the die body 21, respectively. The shell pieces 234Aa to 234Ac are arranged in the direction intersecting the longitudinal direction of the die 20A on the surface of the die body 21 in the same manner as the shell pieces 234*a* to 234*c* (FIG. 4) in the first embodiment.

In the same manner as the removable shell 13A (FIG. 5) of the die 10A, a plurality of convex portions 231*a* are provided on the outer surface 231 of the removable shell 23A. The convex portions 231*a* are provided at a substantially equal density on the outer surface 231. These convex portions 231*a* can be formed, for example, by etching the outer surface 231. In the present embodiment, the convex portions 231*a* are provided over the entire area of the outer surface 231. In other words, the plurality of convex portions 231*a* are formed in each of the plurality of shell pieces 234A. However, these convex portions 231*a* may be formed only in some shell pieces 234A. It is preferable that the convex portions 231*a* are provided so as not to interfere with the through holes 235*a*, 235*b*.

Figure 7:
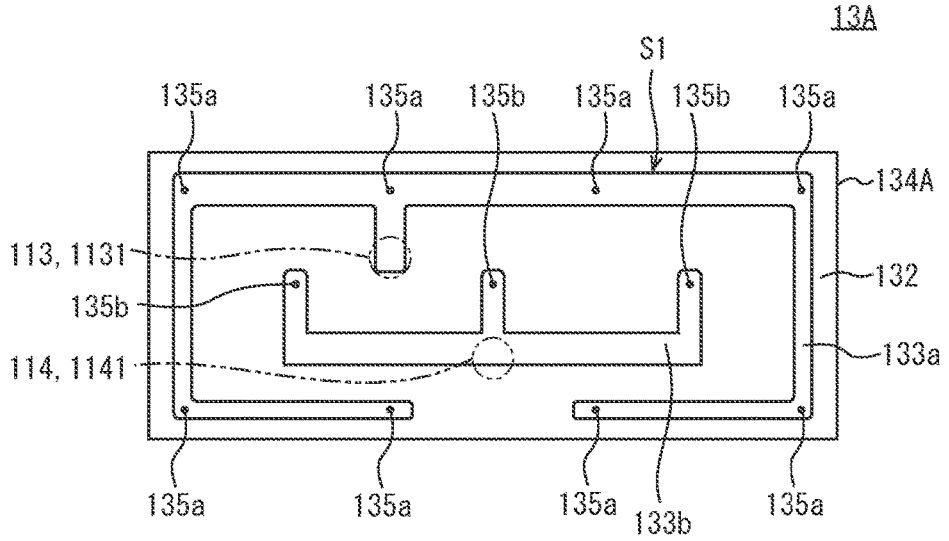
FIG. 7 shows a removable shell, which is included in the die shown in FIG. 5, viewed from the inner surface side.
Figure 8:
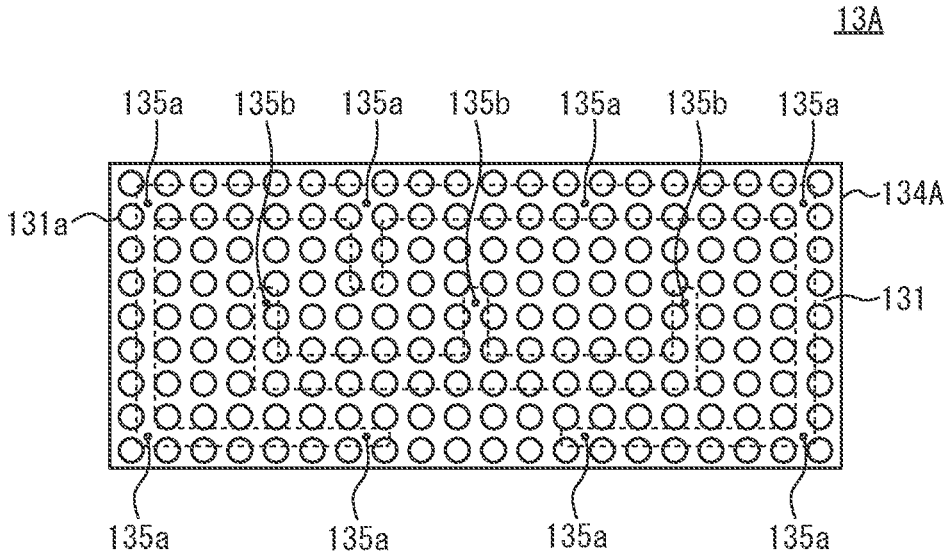
FIG. 8 shows the removable shell shown in FIG. 7, viewed from the outer surface side.

Hereinafter, referring to FIGS. 7 and 8, detailed configuration of the removable shell 13A will be described. Since the configuration of the removable shell 23A (FIG. 6) of the die 20A is roughly the same as the removable shell 13A of the die 10A, description thereof will be omitted. FIG. 7 shows the removable shell 13A of the die 10A viewed from the inner surface 132 side. FIG. 8 shows the removable shell 13A of the die 10A viewed from the outer surface 131 side. In FIGS. 7 and 8, one of the plurality of shell pieces 134A included in the removable shell 13A is exemplified.

As shown in FIG. 7, grooves 133*a*, 133*b* are formed in the inner surface 132 of the removable shell 13A. The grooves 133*a*, 133*b* are formed for each shell piece 134A. The depth of the groove 133*a* and the distance from the outer surface 131 (FIG. 8) to the groove 133*a* in each shell piece 134A are preferably equal to the depth of the groove 133*a* and the distance from the outer surface 131 to the groove 133*a* in another shell piece 134A. Similarly, the depth of the groove 133*b* and the distance from the outer surface 131 to the groove 133*b* in each shell piece 134A are preferably equal to the depth of the groove 133*b* and the distance from the outer surface 131 to the groove 133*b* in another shell piece 134A.

Referring to FIG. 7, the groove 133*a* is in communication with the supply flow channel 113. More specifically, the supply flow channel 113 or the branch supply path 1131 is connected to the groove 133*a*. The groove 133*a* is formed, for example, along the peripheral edge of the shell piece 134A. A plurality of through holes 135*a* that open at the outer surface 131 (FIG. 8) of the removable shell 13A are connected to the groove 133*a*. These through holes 135*a* are arranged at intervals along the groove 133*a*, for example. The through holes 135*a* are located so as not to interfere with the convex portions 131*a* of the outer surface 131.

Referring to FIG. 7, the groove 133*b* is in communication with the discharge flow channel 114. More specifically, the discharge flow channel 114 or the branch discharge path 1141 is connected to the groove 133*b*. In an example of the present embodiment, the groove 133*b* is formed on the inner side of the groove 133*a* along the peripheral edge of the shell piece 134A. A plurality of through holes 135*b* that open at the outer surface 131 (FIG. 8) of the removable shell 13A are connected to the groove 133*b*. These through holes 135*b* are located at a substantially equal interval, for example. The through holes 135*b* are located so as not to interfere with the convex portions 131*a* of the outer surface 131.

Referring back to FIGS. 5 and 6, the dies 10A and 20A according to the present embodiment are configured to cool a formed article in the dies 10A and 20A after the die 20A reaches a bottom dead center. Hereinafter, a cooling method of the formed article will be described.

Referring to FIG. 5, in the die 10A, refrigerant is continuously introduced to the conduit 126 of the die base 12 by the fluid pressure feeding means (not illustrated) described in the first embodiment. The conduit 126 is a concave portion provided in the upper surface 121 of the die base 12, and refrigerant is stored therein. The refrigerant in the conduit 126 flows into the removable shell 13A through the supply flow channels 113 of the die body 11. More specifically, the refrigerant flows into the groove 133*a* of each shell piece 134Aa to 134Ac from the supply flow channel 113 or the branch supply path 1131.

The refrigerant which has flown into the groove 133*a* is ejected from each through hole 135*a*. The refrigerant directly cools the surface of the formed article while passing between the convex portions 131*a* on the outer surface 131 of the removable shell 13A. The forming surface of the die 10A is also cooled by this refrigerant.

The refrigerant which has cooled the formed article and the forming surface of the die 10A is collected in the groove 133*b* of the removable shell 13A through the through holes 135*b*. The refrigerant is discharged from the removable shell 13A by the discharge flow channel 114 or the branch discharge path 1141 of the die body 11. The refrigerant is discharged from the conduit 123 after reaching the conduit 123 through the discharge flow channels 114 of the die body 11 and the connection paths 125 of the die base 12. The refrigerant discharged from the conduit 123 may be discarded or circulated for use.

Referring to FIG. 6, the die 20A also cools the formed article and the forming surface in the same manner as the die 10A. In other words, in the die 20A, the refrigerant is continuously introduced to the conduit 226 of the die base 22 by the fluid pressure feeding means described above (not illustrated). The refrigerant flows into the removable shell 23A through the supply flow channels 213 of the die body 21. The refrigerant flows into the groove 233*a* of each shell piece 234Aa to 234Ac from the supply flow channel 213 or the branch supply path 2131.

After flowing into the groove 233*a*, the refrigerant is ejected from each through hole 235*a*. The refrigerant cools the formed article and the forming surface of the die 20A while passing between the convex portions 231*a* on the outer surface 231 of the removable shell 23A.

Thereafter, the refrigerant is recovered in the groove 233*b* of the removable shell 23A via the through holes 235*b*. The refrigerant is discharged from the removable shell 23A through the discharge flow channel 214 or the branch discharge path 2141 of the die body 21. The refrigerant is discharged from the conduit 223 after reaching the conduit 223 through the discharge flow channels 214 of the die body 21 and the connection paths 225 of the die base 22. The refrigerant discharged from the conduit 223 may be discarded or circulated for use.

In the dies 10A and 20A according to the present embodiment as well, as in the first embodiment, the temperature adjustment spaces S1, S2 are provided in a distributed manner in the removable shells 13A, 23A which are removable with respect to the die bodies 11, 21. Therefore, the working load during press working can be distributed over the contact surfaces between the die bodies 11, 21 and the removable shells 13A, 23A, and the strength of the dies 10A, 20A can be secured.

In the dies 10A and 20A according to the present embodiment, the through holes 135*a*, 235*a* extending from the temperature adjustment spaces S1, S2 to the forming surfaces are provided in the removable shells 13A, 23A. Therefore, the refrigerant supplied to the temperature adjustment spaces S1, S2 can be ejected from the forming surfaces so that it is possible to cool the formed article in the dies 10A and 20A.

In the present embodiment as well, the thicknesses of the removable shells 13A, 23A are small and are, for example, 5 mm to 10 mm. The through holes 135*a*, 235*a* for ejecting refrigerant may be formed in the removable shells 13A, 23A. In other words, since the lengths of the through holes 135*a*, 235*a* for ejecting refrigerant are small, the through holes 135*a*, 235*a* can be easily machined, and the machining efficiency will be improved. For example, even if the diameter required for the through holes 135*a*, 235*a* is small, the through holes 135*a*, 235*a* may be formed in the thin-walled removable shells 13A, 23A, and it is not necessary to form a large number of small-diameter supply flow channels 113, 213 in the die bodies 11, 21. The diameter of the supply flow channels 113, 213 of the die bodies 11, 21 can be made to be a diameter that is easy to be machined. The same applies to the through holes 135*b*, 235*b* for ejecting refrigerant.

As in the first embodiment, even in the dies 10A and 20A according to the present embodiment, the removable shell 13A is divided into the plurality of shell pieces 134A and the removable shell 23A is divided into the plurality of shell pieces 234A. Therefore, replacement is possible for each of shell pieces 134A, 234A. For example, if the convex portions 131*a*, 231*a* on the outer surfaces 131, 231 of the removable shells 13A, 23A are partially worn, the shell pieces 134A, 234A of that portion can be replaced with a new one. In other words, since it is not necessary to repair the entire dies 10A, 20A or to prepare a new die, the reparability of the dies 10A, 20A can be improved.

In the present embodiment, the removable shells 13A, 23A eject the refrigerant in the temperature adjustment spaces S1, S2 only from the outer surfaces 131, 231. However, the removable shells 13A, 23A may be configured to eject refrigerant from the peripheral edge portion thereof in addition to from the outer surfaces 131, 231. The refrigerant ejected from the peripheral edge portion of the removable shells 13A, 23A is supplied, for example, to attachment parts such as locating pins and lifters of the dies 10A, 20A, to cool the attachment parts. When the refrigerant is ejected from the peripheral edge portion of the removable shells 13A, 23A, for example, a step may be provided between the outer surfaces 131, 231 of the removable shells 13A, 23A and the surfaces of the die bodies 11, 21 such that a refrigerant ejection hole in the peripheral edge portion is exposed.

In the present embodiment, a formed article is produced by the dies 10A and 20A, and the formed article is cooled in the dies 10A and 20A as it is. However, it is also possible to use the dies 10A and 20A for simply pressurizing and cooling a high-temperature formed article.

Although each embodiment according to the present disclosure has been described so far, the present disclosure is not limited to the above described embodiments, and various modifications can be made to them within a range not departing from the spirit thereof.

For example, in the dies 10, 20 according to the first embodiment, the refrigerant is not ejected from the temperature adjustment spaces S1, S2 of the removable shells 13, 23, while in the dies 10A, 20A according to the second embodiment, refrigerant is ejected from the temperature adjustment spaces S1, S2 of the removable shells 13A, 23A. However, for example, as in the die 10B shown in FIGS. 9 and 10, by using an opening/closing valve 136 that opens and closes a through hole 135 depending on the feed direction of the refrigerant, ejection and non-ejection of refrigerant can be switched in the removable shell 13B.

Figure 9:
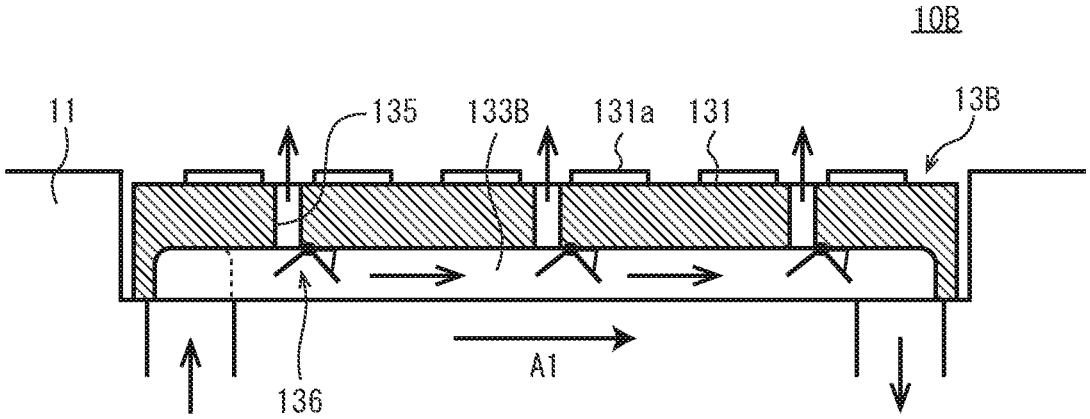
FIG. 9 is a diagram for explaining a die according to a variation of the embodiments.

Referring to FIG. 9, the groove 133B of the removable shell 13B is provided with a plurality of opening/closing valves 136 corresponding to a plurality of through holes 135. Each opening/closing valve 136 is configured so as not to block the corresponding through hole 135 when the refrigerant flows in the feed direction A1. Therefore, while the refrigerant flows in the groove 133B in the feed direction A1, the refrigerant is ejected from the outer surface 131 of the removable shell 13B via each through hole 135. Thereby, the refrigerant can be supplied to the formed article.

Figure 10:
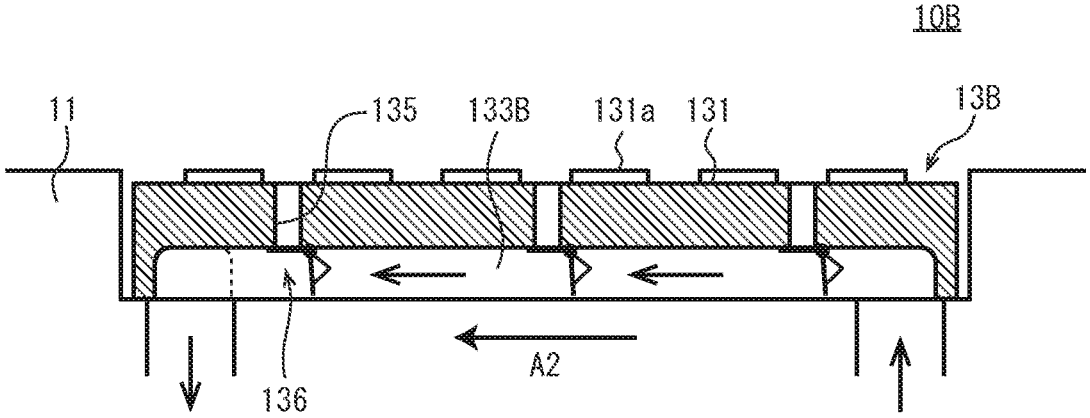
FIG. 10 is another diagram for explaining the die according to the variation.

Referring to FIG. 10, when the refrigerant flows in the groove 133B in the reverse feed direction A2, each opening/closing valve 136 blocks the corresponding through hole 135. Therefore, the refrigerant flows only in the groove 133B and is not ejected from the outer surface 131 of the removable shell 13B. Thereby, the forming surface is cooled from the inside of the die 10B.

In the die 10, 10A, 20, or 20A according to the first embodiment or the second embodiment, substantially the entire forming surface is constituted of the removable shell 13, 13A, 23, or 23A. However, in the die 10, 10A, 20, or 20A, only a part of the forming surface may be constituted of the removable shell 13, 13A, 23, or 23A.

For example, when it is desired that the formed article is partially rapidly cooled and quenched, removable shells 13A, 23A having through holes 135*a*, 135*b*, 235*a*, 235*b* and convex portions 131*a*, 231*a* can be provided only at a region that comes into contact with the rapidly cooled portion of the formed article, out of the dies 10A, 20A according to the second embodiment. Moreover, for example, when press working is performed by using a tailored blank constituted of a plurality of steel sheets having different thicknesses, the removable shells 13A, 23A having through holes 135*a*, 135*b*, 235*a*, 235*b* and convex portions 131*a*, 231*a* may be provided only at a region that comes into contact with a portion which has a large thickness and is difficult to be cooled, out of the dies 10A, 20A. Also when substantially the entire forming surfaces of the dies 10A, 20A are constituted of the removable shells 13A, 23A, the cooling intensity of the formed article can be changed for each region by using, for example, the shell pieces 134A, 234A having through holes 135*a*, 135*b*, 235*a*, 235*b* and convex portions 131*a*, 231*a*, and the shell pieces 134, 234 not having through holes 135*a*, 135*b*, 235*a*, 235*b* in combination. Moreover, even when only a part of the forming surfaces of the dies 10A, 20A is constituted of the removable shells 13A, 23A, the cooling intensity of the formed article can be changed for each region, for example, by using the shell pieces 134A, 234A having through holes 135*a*, 135*b*, 235*a*, 235*b*, and convex portions 131*a*, 231*a*, and the shell pieces 134, 234 not having through holes 135*a*, 135*b*, 235*a*, 235*b* in combination.

In the above described embodiment, the removable shells 13, 13A, 23, 23A constitute the temperature adjustment spaces S1, S2 with the grooves 133, 133*a*, 233, 233*a* formed on the inner surfaces 132, 232, respectively. However, it is also possible to form a space inside the removable shell 13, 13A, 23, or 23A, and to use this space as a temperature adjustment space S1 or S2. However, from the viewpoint of reducing the thicknesses of the removable shells 13, 13A, 23, 23A, it is preferable, as in the above described embodiments, to constitute the temperature adjustment spaces S1, S2 with the grooves 133, 133*a*, 233, 233*a*.

The temperature adjustment spaces S1, S2 may be single concave portions that occupies substantially the entire area of the inner surfaces 132, 232 of the removable shells 13, 13A, 23, 23A. However, as in the above described embodiments, when the temperature adjustment spaces S1, S2 of the removable shells 13, 13A, 23, 23A are the grooves 133, 133*a*, 233, 233*a*, it is advantageous in terms of strength since there are more portions that support the load during press working.

When the grooves 133, 133*a*, 233, 233*a* are formed in the inner surfaces 132, 232 of the removable shells 13, 13A, 23, 23A, grooves corresponding to the grooves 133, 133*a*, 233, 233*a* of the removable shells 13, 13A, 23, 23A may be formed in the surface of the die bodies 11, 21. Thereby, the volume of the temperature adjustment spaces S1, S2 can be enlarged, thus enabling to increase the flow rate of the fluid through the temperature adjustment spaces S1, S2. Moreover it is also possible to form grooves only on the surfaces of the die bodies 11, 21 without forming the grooves 133, 133*a*, 233, 233*a* on the inner surfaces 132, 232 of the removable shells 13, 13A, 23, 23A. In this case, the temperature adjustment spaces S1, S2 are formed by the groove in the surface of the die bodies 11, 21. However, when grooves are provided on the surfaces of the die bodies 11, 21, the reparability of the die bodies 11, 21 deteriorates. Therefore, it is preferable that as in the above described embodiments, the grooves 133, 133*a*, 233, 233*a* are provided in the inner surfaces 132, 232 of the removable shells 13, 13A, 23, 23A, and no groove is provided in the surfaces of the die bodies 11, 21.

Figure 11:
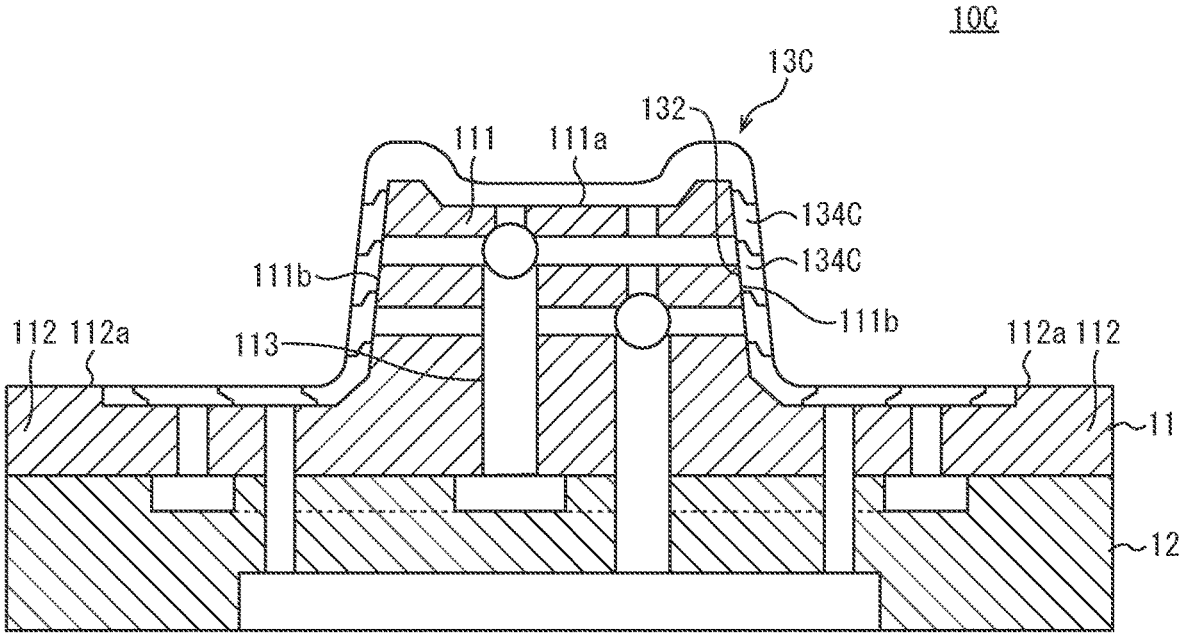
FIG. 11 is a cross-sectional view of a die according to another variation of the embodiments.

The removable shells 13, 13A, 23, 23A can also be divided into smaller pieces. For example, in the die 10C shown in FIG. 11, the removable shell 13C is finely divided in the side surfaces 111*b* of the punch part 111 and the upper surfaces 112*a* of the flange parts 112. In the removable shell 13C, each shell piece 134C is configured such that a boundary surface between adjacent shell pieces 134C intersects the load direction during press working. Each shell piece 134C has an uneven shape in the boundary surface that fits with the adjacent shell piece 134C. According to such a configuration, each shell piece 134C becomes unlikely to be detached from the die body 11, and it becomes possible to reduce need of a knock pin, a bolt, and the like for fixing the shell piece 134C to the die body 11. Further, since the shell pieces 134C can be closely adhered to each other using the load during press working, it is possible to prevent a gap from occurring on the forming surface of the die 10C.

In the inner surface 132 of the removable shell 13C, a groove 133 (FIG. 3) or grooves 133*a*, 133*b* (FIG. 7) can be formed as in each embodiment described above. The groove 133 or the grooves 133*a*, 133*b* can be formed on the inner surface 132 such that they are connected between adjacent shell pieces 134C, for example. In this case, since a fluid for temperature adjustment can be supplied from one flow channel 113 to the plurality of shell pieces 134C, it is possible to reduce the number of flow channels 113 in the die body 11. Therefore, the production of the die body 11 becomes easier, and the strength of the die body 11 can be further improved.

In the first embodiment, the dies 10, 20 have the removable shells 13, 23, respectively. However, only one of the dies 10, 20 may have a removable shell. Similarly, in the second embodiment, only one of the dies 10A, 20A may have a removable shell.

In the above described embodiments, three supply flow channels 113 are provided for each die body 11. Moreover, two branch supply paths 1131 are provided in the supply flow channel 113 that opens at the top surface 111*a* of the punch part 111, among the supply flow channels 113. However, the number and arrangement of the supply flow channels 113 and the branch supply paths 1131 are not limited thereto. Similarly, the number and arrangement of the discharge flow channels 214 and the branch discharge paths 2141 in the die body 21 are not particularly limited. Further, the discharge flow channels 114, 214 and the branch discharge paths 1141, 2141 can be used for supplying the fluid, and the supply flow channels 113, 213 and the branch supply paths 1131, 2131 can be used for discharging the fluid.

REFERENCE SIGNS LIST

10, 10A to 10C, 20, 20A: Die
11, 21: Die body
113, 213: Supply flow channel
12, 22: Die base
13, 13A to 13C, 23, 23A: Removable shell
131, 231: Outer surface
132, 232: Inner surface
133, 133*a*, 133B, 233, 233*a*: Groove
134, 134*a* to 134*c*, 134A, 134Aa to 134Ac, 134C, 234, 234*a* to 234*c*, 234A, 234Aa to 234Ac: Shell piece
135, 135*a*, 235*a*: Through hole
S1, S2: Temperature adjustment space

The invention claimed is:

1. A die including a forming surface, comprising:

a die body including a supply flow channel which is formed inside the die body, one end of which opens at a surface of the die body, and to which fluid for temperature adjustment is to be supplied; and a removable shell having a thickness of 5 mm to 10 mm, the removable shell mounted removably to the surface of the die body and includes an outer surface constituting at least a part of the forming surface, wherein a temperature adjustment space which is in communication with the supply flow channel is provided in the removable shell, the removable shell is divided into a plurality of shell pieces, and the plurality of shell pieces are arranged in a direction intersecting a longitudinal direction of the die on the surface of the die body.

2. The die according to claim 1, wherein the removable shell further includes a through hole one end of which opens in the temperature adjustment space, and the other end of which opens at the outer surface.

3. The die according to claim 1, wherein the temperature adjustment space is formed of a groove, the groove being provided in an inner surface which is a surface on the die body side of the removable shell.

4. The die according to claim 2, wherein the temperature adjustment space is formed of a groove, the groove being provided in an inner surface which is a surface on the die body side of the removable shell.

* * * * *